United States Patent [19]

Poole

[11] Patent Number: 4,826,407

[45] Date of Patent: May 2, 1989

[54] ROTARY VANE PUMP WITH BALLAST PORT

[75] Inventor: Robert E. Poole, Northants, England

[73] Assignee: The Utile Engineering Co. Ltd., Irthlingborough, England

[21] Appl. No.: 110,904

[22] Filed: Oct. 21, 1987

[30] Foreign Application Priority Data

Oct. 22, 1986 [GB] United Kingdom ..... 8625337

[51] Int. Cl.[4] ..... F04C 18/344; F04C 29/04; F04C 29/10

[52] U.S. Cl. ..... 418/15

[58] Field of Search ..... 418/15, 97, 180

[56] References Cited

U.S. PATENT DOCUMENTS

| | | | |
|---|---|---|---|
| 2,639,855 | 5/1953 | Daniels | 418/15 |
| 2,779,533 | 1/1957 | Zlock | 428/15 |
| 2,885,143 | 5/1959 | Dubrovin | 418/15 |
| 3,199,771 | 8/1965 | Becker | 418/15 |
| 4,295,804 | 10/1981 | Pezzot | 418/15 |

FOREIGN PATENT DOCUMENTS

| | | |
|---|---|---|
| 670793 | 4/1952 | United Kingdom . |
| 2087484 | 5/1982 | United Kingdom . |

*Primary Examiner*—John J. Vrablik

*Attorney, Agent, or Firm*—Pollock, Vande Sande & Priddy

[57] ABSTRACT

Rotary vane pump with ballast ports which introduce air into the swept cells before they reach the pump outlet port. To prevent overheating at very high vacuums, the ballast ports are arranged to provide a ratio of ballast air flow to pump displacement, at a standard working vacuum of 20 inches Hg gauge, of at least 35%. This permits operating at 25 inches Hg gauge without the need for a cooling fan.

13 Claims, 6 Drawing Sheets

ROTARY VANE PUMP WITH BALLAST PORT

FIELD OF THE INVENTION

This invention relates to pumps, and in particular rotary vane pumps having a rotor which includes a plurality of outwardly projecting sliding vanes arranged to sweep the inside surface of a pumping chamber, the rotor being rotatably mounted in the chamber for displacement of fluid between an inlet to and an outlet from the pumping chamber.

BACKGROUND OF THE INVENTION

FIGS. 1 and 2 of the accompanying drawings are schematic transverse sectional views of a prior art rotary vane pump and illustrate the arrangement of components in such a pump, and the way in which the pump operates. The rotor includes a rotor member 1 which is in this case cylindrical, and is mounted eccentrically within a cylindrical pumping chamber 2 formed in a pump casing 3. The casing 3 is formed with inlet and outlet ports 4 and 5 which open into the pumping chamber 2 at positions which are approximately diametrically opposed with respect to the axis of the rotor member 1. The rotor further includes a plurality (six in the illustrated arrangement) of circumferentially spaced vanes 6 which can slide inwardly and outwardly relative to the rotor member 1 in corresponding axially extending slots 7 formed in the rotor member 1. The slots in this particular case are non-radial, but are formed so that the vanes project forwardly by a predetermined angle $\alpha$ relative to the normal to the surface of the cylindrical rotor member 1. The slots could however be radial. In use, the vanes 6 are thrown outwardly relative to their slots by centrifugal force so that their outer edges are maintained in sweeping contact with the inner cylindrical surface 2' of the pumping chamber 2. The illustrated arrangement is adapted for clockwise rotation of the rotor.

As is well known, rotation of the rotor causes fluid displacement from the inlet 4 to the outlet 5 so as to create a higher pressure at the outlet than at the inlet. In FIG. 1, the rotor is shown in a position in which it has just trapped a "cell" of fluid A between the wall 2' of the pumping chamber, the outer cylindrical wall 1' of the rotor member 1, and two adjacent vanes 6. It will be seen that as the rotor rotates clockwise from this position, the cell A reduces in volume so as to compress the fluid, the maximum compression being attained when the cell A reaches the position shown in FIG. 2, i.e., when the vane at the leading end of the cell is about to reach the outlet port 5. Thereafter, the fluid is exhausted from the cell A into the outlet port. This process of cell creation, displacement and fluid exhaust occurs continuously at very high speed to produce the required pumping action.

The pump can generally be operated selectively in the compression or vacuum mode. In the compression mode, the equipment to receive the compressed fluid is coupled to the outlet port 5, the fluid being freely supplied to the inlet port. In the vacuum mode, the equipment to which the vacuum is to be applied is coupled to the inlet port, the fluid being freely exhausted from the outlet port.

Rotary vane pumps of this kind are generally reliable, efficient and rugged. However, when operating in the vacuum mode at very low absolute pressures, a large amount of heat is generated, and steps must be taken to remove this heat if overheating is to be avoided. It is known to form the outside of the casing 3 with cooling fins, but in general, cooling by natural convection over these fins is insufficient. In installations where a supply of cooling water is available, a sufficient degree of cooling can be ensured. However, in many applications water-cooling is not possible or at least inconvenient to arrange. As an alternative, it is known to employ air cooling using a fan arranged to blow cooling air over the outside of the casing. However, even this has disadvantages in that the cooling fan is noisy, and since it is normally driven from the pump shaft, imposes an additional load on the drive source.

To avoid these problems, it has been proposed in the past to reduce the effect of heat generation in the vacuum mode due to the compression of the fluid from the intake vacuum to a higher pressure, which is usually atmospheric, over the whole of the arc between the inlet and outlet ports. This has been done by introducing cooling fluid into the chamber through an additional port formed in the pump casing at a circumferential position which is upstream of the outlet port with respect to the direction of rotation of the rotor. With reference to FIG. 3 of the accompanying drawings, this additional port, hereinafter referred to as the ballast port, is indicated by reference numeral 17.

The circumferential spacing between the inlet port 4 and this ballast port 17 is slightly greater than the circumferential extent of an inter-vane cell, so that the inlet and ballast ports are never in communication. This is important, since the ballast port 17 is intended to relieve the vacuum in the cell by introducing ballast fluid at a high pressure relative to the vacuum into the cell. In the position of the rotor shown in FIG. 3, a cell A has just been closed, and the preceding cell B has almost completely swept past the ballast port 17, so that the vacuum in this cell B has been partly relieved by the introduction of ballast fluid.

The ballast port and the outlet will normally be open to the atmosphere, the inlet port being coupled to the equipment to which a vacuum is to be applied. It has been proposed to provide one or two such ballast ports.

Although the cooling effect achieved using existing arrangements for the introduction of ballast air has satisfactorily avoided the need for a cooling fan at low and medium vacuum levels, it has been found necessary to add a cooling fan if operation at high vacuum (in excess of 25 inches Hg gauge, or 635 mm Hg gauge) is required.

SUMMARY OF THE INVENTION

The present invention is directed to this problem and seeks to enhance the cooling efficiency in a rotary vane pump operating in vacuum mode. To achieve this end, the invention provides a rotary vane pump having ballast fluid port means for the introduction of ballast fluid into the swept cells before they reach the outlet port in operation as a vacuum pump, the arrangement being such as to provide an inward flow of cooling ballast fluid which is significantly greater than in existing pumps, thereby to improve the cooling efficiency.

The improved ballast air flow may be achieved by enlarging the ballast port or ports, or more preferably by increasing the number of such ports.

The improved flow can be quantified by reference to the ratio of the volume flow rate of the inflowing ballast air to the pump displacement at a given working vacuum. As is well known, this latter parameter, normally measured in cubic feet per minute or cubic meters per hour, has a fixed value for any given speed of rotation of the rotor, this value being determined by the geometry of the pump. For example, in the arrangement shown in FIG. 3, the displacement is equal to the maximum cell volume × the 6(number of vanes) × rate of revolution. The flow of ballast air can readily be measured by a flow meter coupled to the ballast port or ports.

Measurements taken during extensive bench tests have shown that in existing pumps a maximum possible value for this ballast fluid/displacement ratio is about 30% at a vacuum of 20 inches Hg gauge, and that in the absence of a cooling fan, overheating occurs at operating vacuums of approximately 25 inches Hg gauge.

In accordance with the invention, we propose to increase this ratio, and extensive and complex experimentation and testing has shown that performance can be improved surprisingly by enlarging the ballast ports or increasing their number so as to increase this ballast air/displacement ratio at 20 inches Hg gauge to 35% or more. At this value, it was found that pumps could be operated for long periods at a vacuum of 25 inches Hg gauge without overheating, even in the absence of a cooling fan.

According to one aspect of the invention, therefore, there is provided a rotary vane pump operable in a vacuum mode, and comprising:

a pump casing defining an internal cylindrical pumping chamber, and circumferentially spaced inlet and outlet ports in communication with said pumping chamber; and a rotor which is eccentrically mounted within said pumping chamber and which includes a plurality of circumferentially distributed sliding vanes having axially extending outer edges for making sweeping contact with the internal wall of the pumping chamber as the rotor is rotated, so as to define a plurality of swept cells which rotate around the rotor axis, said cells progressively reducing in volume as they move from a position communicating with the inlet port to a position communicating with the outlet port, the pump casing including ballast port means for the introduction of ballast fluid into the swept cells after they leave the inlet port and before they reach the outlet port in the vacuum mode of operation, the ballast port means being such as to provide an inward flow of cooling ballast fluid which when the pump is operating at a vacuum at the inlet port of 20 inches Hg gauge (508 mm Hg gauge) produces a ballast fluid/displacement ratio of at least 35%.

By increasing the ratio even further, for example to at least 40% at 20 inches Hg gauge, it was found that pumps could be operated with an effectively closed inlet equivalent to a vacuum level in excess of approximately 28 inches Hg gauge for extended periods without overheating, and again without the need for a cooling fan.

It will be appreciated, therefore, that the present invention provides very significant improvement in operation of rotary vane pumps in vacuum mode by increasing the cooling effect due to ballast air so that cooling by use of a cooling fan is no longer (essential) at vacuum levels which hitherto were not possible without the presence of a cooling fan.

The ballast port means may comprise a plurality of openings in said internal wall of the pumping chamber, said openings being spaced apart along said pumping chamber. Alternatively, the ballast port means may comprise an elongate opening in said internal wall, said opening extending along the pumping chamber. In either case, the opening or openings may be formed so that, as a vane edge sweeps said opening or openings, the ballast port means opens progressively in an axial sense into the succeeding swept cell.

In the disclosed embodiments, the opening extends or the openings are aligned, obliquely relative to the axis of the pumping chamber. The shape of the opening, or the distribution of the openings, may form a substantially a V-shape in which the apex is located intermediate the length of the pumping chamber and confronting the approaching vane edges. Alternatively, the shape of the opening or the distribution of the openings may form a single line extending along the pumping chamber and obliquely to its axis, the opposite ends of said line being those parts of the ballast port means nearest corresponding opposite ends of the pumping chamber which are first and last to be encountered by the approaching vane edges and therefore first and last to open into the sweep cells, respectively.

The pump may also be operable in a compression mode, valve means being provided for closing said ballast port means during operation of the pump in said compression mode.

The pump may include ballast fluid manifold means defining a ballast fluid manifold chamber which communicates with said ballast fluid port means in said pump casing, and which has a single ballast fluid intake.

The ballast fluid is preferably air at atmospheric pressure.

According to the invention there is also provided a rotary vane pump having ballast fluid port means for the introduction of ballast fluid into the swept cells before they reach the outlet port in operation as a vacuum pump, the arrangement being such as to provide an inward flow of cooling ballast fluid which, when the pump is operating at a vacuum at the inlet port of 20 inches Hg gauge (508 mm Hg gauge), produces a ballast fluid/displacement ratio of at least 35%.

In another aspect, the invention provides a rotary vane pump having ballast fluid port means for the introduction of ballast fluid into the swept cells before they reach the outlet port in operation as a vacuum pump, wherein said ballast fluid port means comprises one or more openings into the pumping chamber adapted to open progressively into the swept cells when swept by the vane edges.

In a further aspect, the invention provides a rotary vane pump having ballast fluid port means for the introduction of ballast fluid into the swept cells before they reach the outlet port in operation as a vacuum pump, wherein said ballast fluid port means includes an opening in an axially facing end wall of the pumping chamber.

BRIEF DESCRIPTION OF THE DRAWINGS

In order that the invention may be more clearly understood, reference will now be made to the accompanying drawings, wherein several embodiments are shown for purposes of illustration, and wherein.

DESCRIPTION OF PREFERRED EMBODIMENTS

Figure 1:
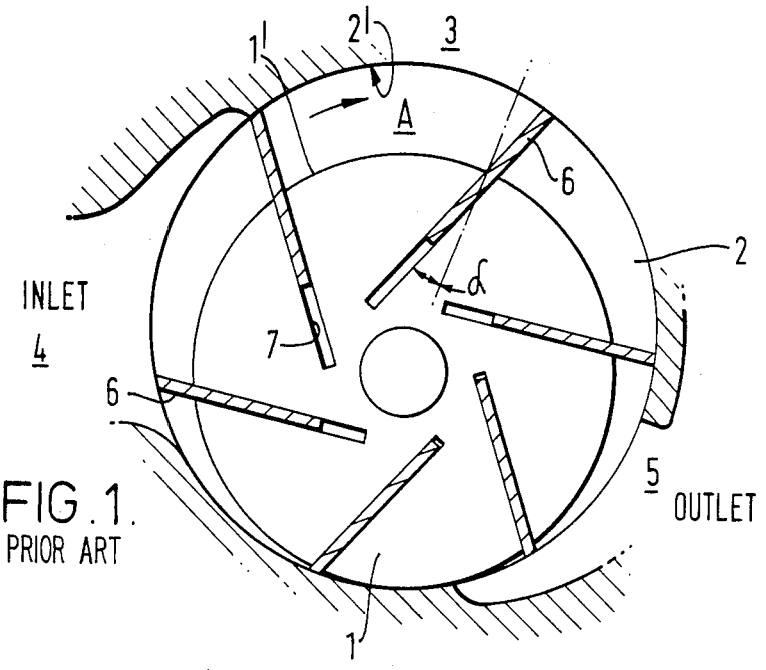
FIG. 1. PRIOR ART
FIGS. 1 to 3 are schematic transverse sectional views of prior art rotary vane pumps.
Figure 2:
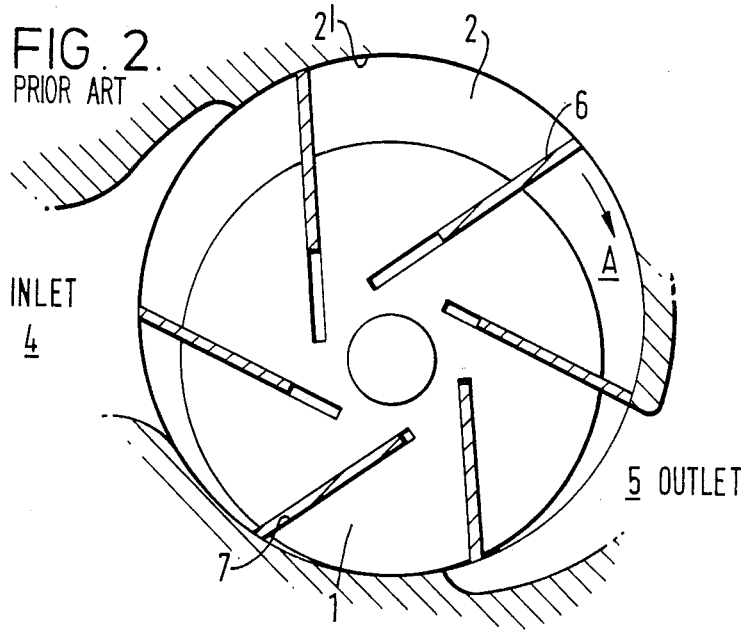
FIG. 2. PRIOR ART
Figure 3:
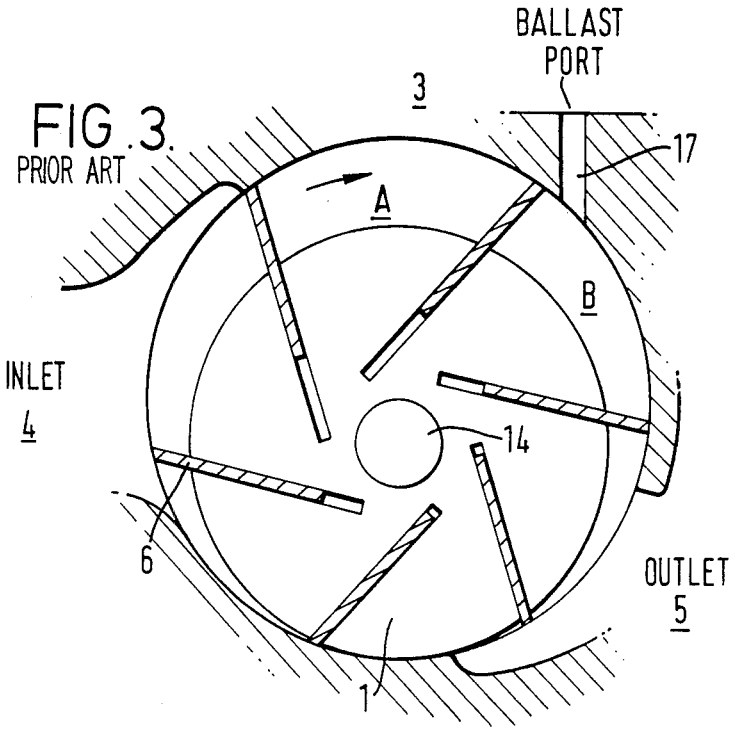
FIG. 3. PRIOR ART

Similar reference numerals are used in FIGS. 4 to 8 for parts corresponding to the components illustrated schematically in FIG. 3. Bolted to opposite ends of the casing 3 are respective end plates 11, each formed integrally with cooling fins 12 and a bearing housing 13 accommodating a bearing for the projecting shaft portion 14 of the rotor member.

A lubricating device 24 may be provided for supplying oil into the casing and also into the end plates 11 for lubricating the axial end edges of the vanes as they sweep flat inwardly facing surfaces of the end plates and the cylindrical chamber wall 2'.

The casing 3 is integrally formed with a plurality of axially extending cooling fins 15 and a ballast port block 16. A plurality of axially spaced-apart ballast ports 17 (seven in this case) are drilled through this ballast port block 16 to communicate with the pumping chamber 2 in the manner already described. A ballast inlet manifold 18 having a common air intake port 18' is mounted on the ballast port block 16 by means of bolts 19 screwed into screw-threaded bolt holes 20.

In use, ballast air is drawn into the manifold 18 through the intake 18' whence it is distributed to the ballast inlet ports 17 for introduction into the rotating cells A formed in the pumping chamber 2.

If the pump is to be operable also in a compression mode, a valve 21 should be coupled to the intake 18', this valve being closed for compression operation to avoid loss of operating pressure through the ballast ports 17.

Figure 6:
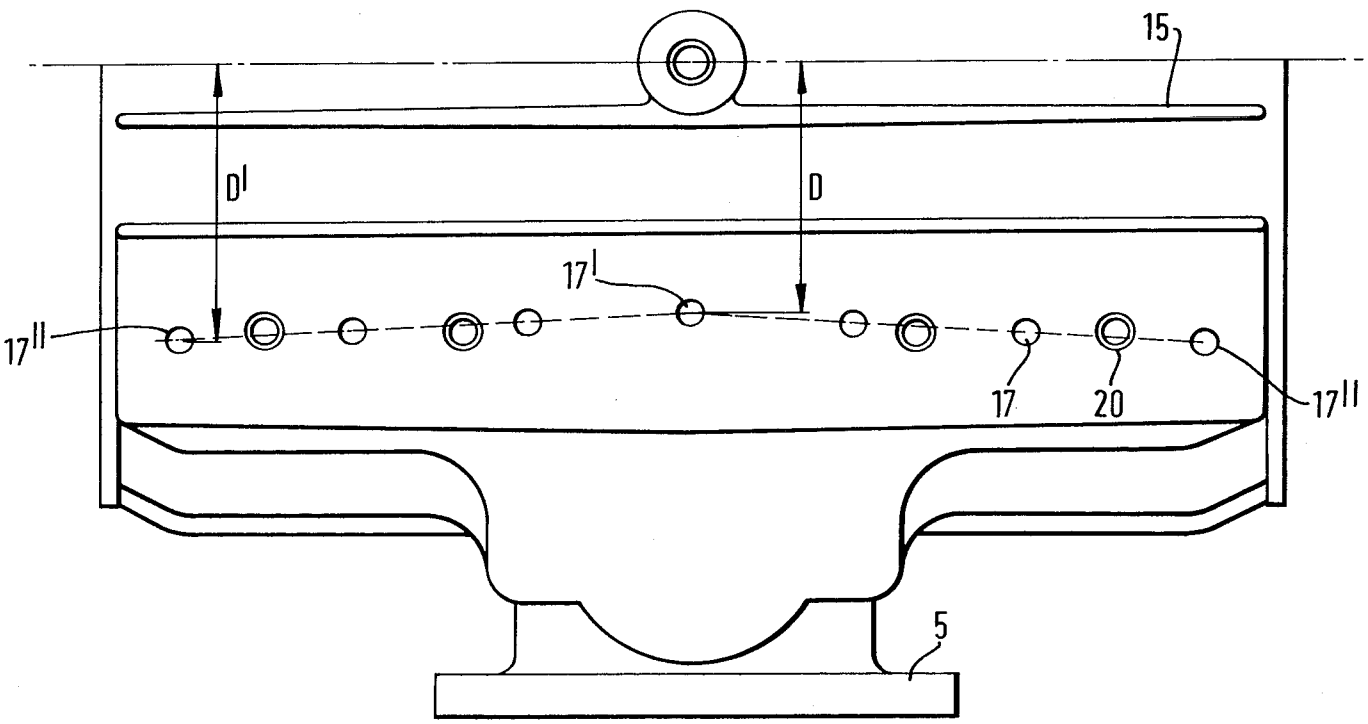
FIG. 6 is a plan view of the upper right hand part of the pump casing of FIG. 5, of the pump of FIG. 4, as viewed in the direction C and shown with a ballast manifold removed.

Although it is possible for the ballast ports 17 to be aligned axially, it has been found that such an arrangement causes a phenomenon known as vane bounce in which the vanes vibrate slightly as they sweep the openings 22 of the ballast ports 17 on the cylindrical surface 2' of the pumping chamber. Over an extended period of use this vane bounce tends to damage the surface 2', causing the formation of ripples on this surface and an attendant deterioration in performance. On the supposition that this vane bounce results from the sudden increase in pressure in a swept cell A as the vane tip, or edge, encounters all of the openings 22 at exactly the same time, we proposed and tested an arrangement, as illustrated in FIG. 6, in which the ports 17 are distributed along a shallow V-shape, (see broken line) a port 17' at the apex of this V being located intermediate the length of the pumping chamber and confronting the approaching vane edges. It will be appreciated that in such an arrangement the ballast port means constituted by the seven ballast ports 17 opens progressively, in an axial sense, into a swept cell as a vane edge sweeps past, beginning with the central port 17', and finishing with the two outermost ports 17".

Testing has also shown that vane bounce can be further reduced by the provision of a ballast port 23 in each end plate 11, these ports 23 being formed at an angular position relative to the rotor axis so that they are swept by the axial end edges of the vanes 6 at substantially the same time as, or in a predetermined timed relationship, with, the opening of the circumferential ballast ports 17 into the swept cells. These end ports 23 may replace one or more of the circumferential ports; in an actual tested machine the three axially central ports 17 in FIG. 6 were replaced by the end ports 23, one in each end plate. In general, it will be appreciated that the ballast ports may be provided in the end plates instead of or as well as in the cylindrical wall of the pump casing.

Figure 7:
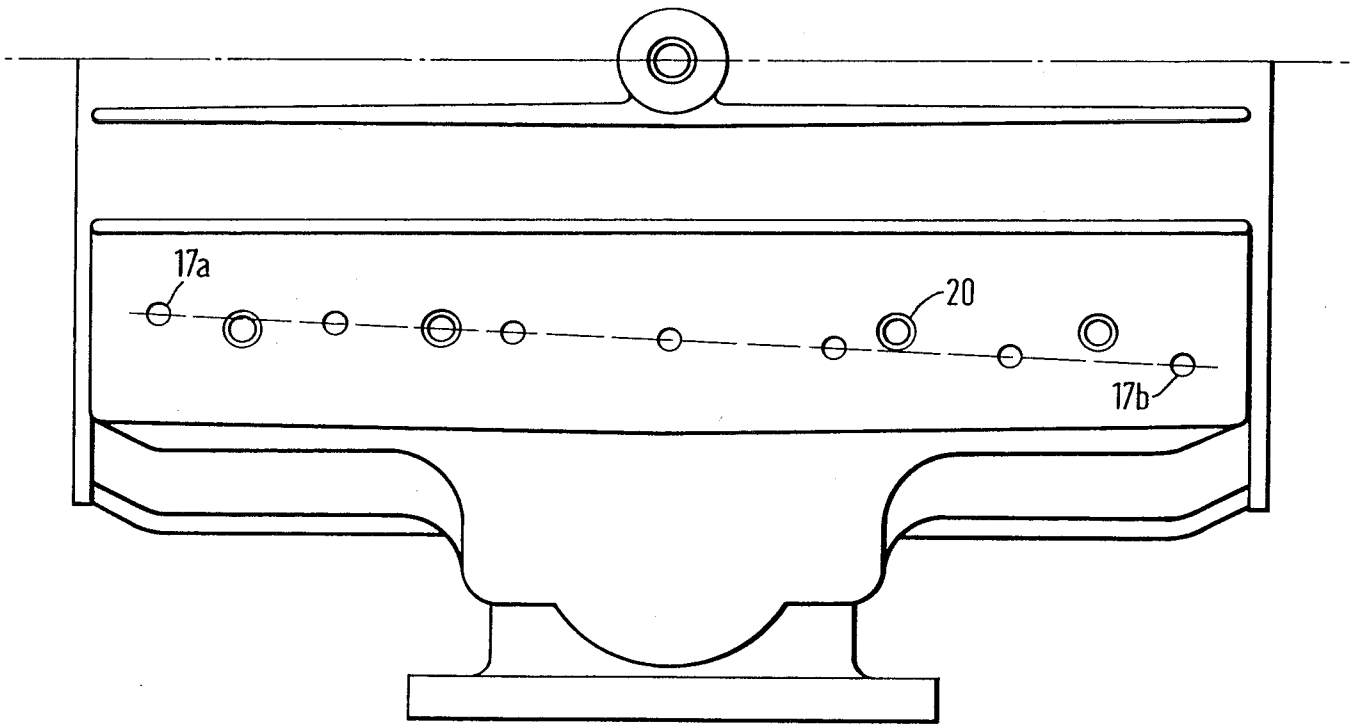
FIG. 7 is a plan view similar to FIG. 6 but showing a modified ballast port arrangement.
Figure 8:
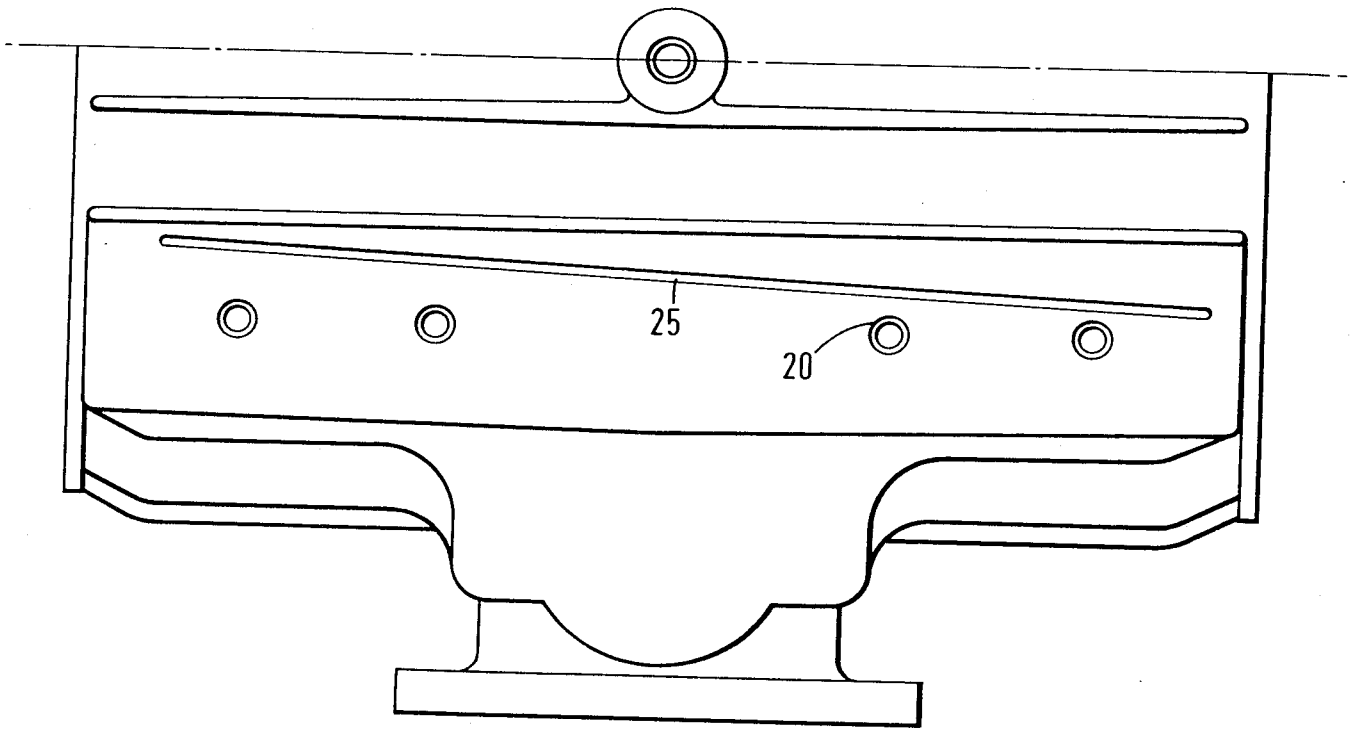
FIG. 8 is another plan view similar to FIG. 6, showing another modified ballast port arrangement.

Port configurations other than that of FIG. 6 for producing this progressive opening in use are possible. FIG. 7 illustrates a possible alternative configuration, in which the ports 17 form a single line extending along the pumping chamber and obliquely to its axis. The port 17*a* at one end of the line is the first, and the port 17*b* at the other end is the last to be encountered by the vane edges as they sweep the ports.

Furthermore, although the ballast port means in the foregoing embodiments consist of a number of discrete axially spaced ports, these could be replaced by one or more slot-type ports, extending along the pumping chamber. In the arrangement illustrated in FIG. 8, a slot 25 forms a single elongate opening in the surface 2' of the pumping chamber.

It will be noted that the above embodiments include ballast port means extending substantially the whole length of the pumping chamber. This has been found to give the best results, but a shorter spread of ballast ports can give satisfactory performance.

Figure 4:
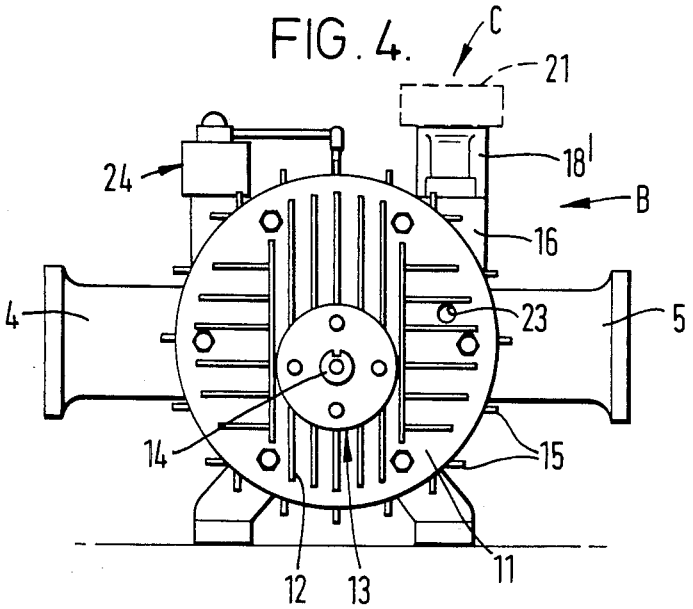
FIG. 4 is an end elevational view of a rotary vane pump in accordance with the invention.
Figure 5:
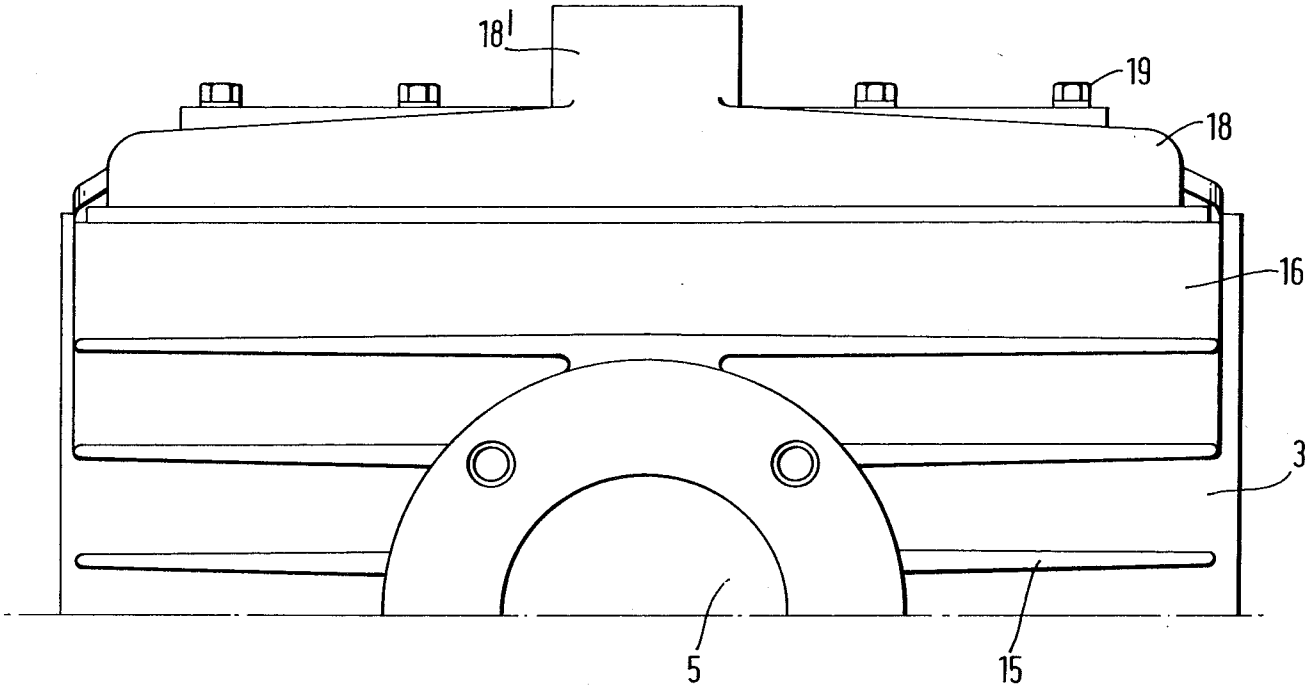
FIG. 5 is a side elevational view of the upper part of the casing of the rotary vane pump of FIG. 4, as viewed from the outlet port side in the direction B, shown with end plates removal, and ballast manifold attached.

In a particular machine constructed in accordance with the embodiment disclosed with reference to FIGS. 4 to 6, the values for various dimensions and parameters were as follows:

| | |
|---|---|
| Diameter of pumping chamber | 10" (254 mm) |
| Axial length of pumping chamber | 15.625" (397 mm) |
| Diameter of rotor | 8.3" (211 mm) |
| Number of vanes | 6 |
| Diameter of ballast port | 0.375" (9.52 mm) |
| Axial spread of ballast ports | 13.875" (352 mm) |
| Distance D (see FIG. 6) | 3.5" (88.9 mm) |

It will be clear to those skilled in the art that numerous modifications of the described arrangements are possible within the scope of the invention, as defined earlier.

I claim:

1. A rotary vane pump operable in a vacuum mode, and comprising (a) a pump casing defining an internal cylindrical pumping chamber, and an inlet port and an outlet port circumferentially spaced from said inlet port, said inlet and outlet ports being in communicating with said pumping chamber; and (b) a rotor which is eccentrically mounted within said pumping chamber and which includes a plurality of circumferentially distributed sliding vanes having axially extending outre edges for making sweeping contact with an internal wall of said pumping chamber as said rotor is rotated, so as to define a plurality of swept cells which rotate around an axis of said rotor, said cells progressively reducing in volume as they move from a position communicating with said inlet port to a position communicating with said outlet port;

(c) said pump casing including ballast port means for the introduction of ballast fluid into said swept cells after they leave said inlet port and before they reach said outlet port in a vacuum mode of operation, said ballast port means comprising at least one opening into said pumping chamber, said at least one opening being formed so that, as an edge of a vane sweeps said at least one opening, said ballast port means opens progressively into a said swept cell following that vane.

2. A rotary vane pump according to claim 1, wherein said ballast port means comprises a plurality of openings in said internal wall of said pumping chamber, said openings being spaced apart along said pumping chamber.

3. A rotary vane pump according to claim 1, wherein said ballast port means comprises an elongate opening in said internal wall of said pumping chamber, said opening extending along said pumping chamber.

4. A rotary vane pump according to claim 1, wherein said at least one opening extends obliquely relative to the axis of the pumping chamber.

5. A rotary vane pump according to claim 4, wherein the shape or distribution of said at least one opening forms a substantially V-shape in which an apex of the V is located intermediate the length of said pumping chamber and confronting approaching vane edges.

6. A rotary vane pump according to claim 4, wherein the shape or distribution of said at least one opening forms a single line extending along said pumping chamber and obliquely to its axis, opposite ends of said line being those parts of the ballast port means nearest corresponding opposite ends of said pumping chamber which are first and last to be encountered by approaching vane edges and therefore first and last to open into swept cells, respectively.

7. A rotary vane pump according to claim 1, comprising valve means for closing said ballast port means during operation of said pump in a compression mode.

8. A rotary vane pump according to claim 1, including ballast fluid manifold means defining a ballast fluid manifold chamber which communicates with said ballast fluid port means in said pump casing, and which has a single ballast fluid intake.

9. A rotary vane pump according to claim 1, wherein said ballast fluid is air at atmospheric pressure.

10. A rotary vane pump having a pump casing defining an internal cylindrical pumping chamber, an outlet port, vanes and ballast fluid port means for the introduction of ballast fluid into swept cells of said pumping chamber before they reach said outlet port during operation as a vacuum pump, wherein said ballast fluid port means comprises at least one opening into said pumping chamber, said at least one opening being formed so that, as an edge of a said vane sweeps said at least one opening, said ballast port means opens progressively into a said swept cells following that vane edge.

11. A rotary vane pump according to claim 1 or 10, wherein said pump casing includes axially facing end walls enclosing the cylindrical pumping chamber at opposite ends thereof and wherein said ballast fluid port means includes at least one opening in at least one of said axially facing end walls of said pump casing.

12. A rotary vane pump according to claim 1 or 10, the arrangement being such as to provide an inward flow of cooling ballast fluid which, when the pump is operating at a vacuum at the inlet port of 20 inches Hg gauge (508 mm Hg gauge), produces a ballast fluid/displacement ratio of at least 35%.

13. A rotary vane pump according to claim 1, wherein said ballast fluid/displacement ratio is at least 40%.

* * * * *